US011326448B2

(12) United States Patent
Alruwaili

(10) Patent No.: US 11,326,448 B2
(45) Date of Patent: May 10, 2022

(54) PRESSURE TESTING SYSTEMS FOR SUBTERRANEAN ROCK FORMATIONS

(71) Applicant: Saudi Arabian Oil Company, Dhahran (SA)

(72) Inventor: Khalid Mohammed M. Alruwaili, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 215 days.

(21) Appl. No.: 16/703,297

(22) Filed: Dec. 4, 2019

(65) Prior Publication Data

US 2021/0172315 A1 Jun. 10, 2021

(51) Int. Cl.
*E21B 49/00* (2006.01)

(52) U.S. Cl.
CPC ..... *E21B 49/006* (2013.01)

(58) Field of Classification Search
CPC ..... E21B 49/006; E21B 33/129; E21B 17/18
See application file for complete search history.

(56) References Cited

U.S. PATENT DOCUMENTS

| | | | |
|---|---|---|---|
| 2,688,369 | A | 9/1954 | Broyles |
| 2,699,212 | A | 1/1955 | Dismukes |
| 3,254,720 | A | 8/1966 | Huitt |
| 4,149,409 | A | 4/1979 | Serata |
| 4,687,061 | A | 8/1987 | Uhri |
| 5,111,881 | A | 5/1992 | Soliman et al. |
| 5,277,062 | A | 1/1994 | Blauch et al. |
| 5,517,854 | A | 5/1996 | Plumb et al. |
| 6,843,233 | B2 | 1/2005 | Berger et al. |
| 7,828,063 | B2 | 11/2010 | Olsen et al. |

(Continued)

FOREIGN PATENT DOCUMENTS

| | | |
|---|---|---|
| CN | 101726223 | 6/2010 |
| WO | WO 2009001069 | 12/2008 |

(Continued)

OTHER PUBLICATIONS

PCT International Search Report and Written Opinion issued in International Application No. PCT/US2020/063209 dated Mar. 15, 2021, 14 pages.

(Continued)

*Primary Examiner* — Regis J Betsch
*Assistant Examiner* — Kaleria Knox
(74) *Attorney, Agent, or Firm* — Fish & Richardson P.C.

(57) ABSTRACT

A pressure testing system for analyzing a rock formation includes a tubular support member sized to pass into a wellbore of the rock formation and an adjustable loading device configured to exert a radial load against the wall of the wellbore. The adjustable loading device includes multiple expandable members distributed around a circumference of the tubular support member and configured to expand to respectively exert multiple radial pressures against the wall of the wellbore that together provide the radial load. The pressure testing system further includes a control module configured to selectively control expansion of each expandable member of the multiple expandable members to vary the radial load exerted by the adjustable loading device as a function of an angle around the circumference of the tubular support member.

18 Claims, 3 Drawing Sheets

(56) References Cited

U.S. PATENT DOCUMENTS

| | | | |
|---|---|---|---|
| 8,265,915 | B2 | 9/2012 | Hsu et al. |
| 8,631,872 | B2 | 1/2014 | East |
| 2011/0017458 | A1 | 1/2011 | East et al. |
| 2011/0067870 | A1 | 3/2011 | East |
| 2013/0199787 | A1 | 8/2013 | Dale et al. |
| 2014/0078288 | A1 | 3/2014 | Wu |
| 2015/0136388 | A1 | 5/2015 | Fehr et al. |
| 2016/0201440 | A1 | 7/2016 | Aidagulov |
| 2017/0030188 | A1 | 2/2017 | Lehr |
| 2018/0266183 | A1 | 9/2018 | Ayub |
| 2018/0371903 | A1 | 12/2018 | Li et al. |

FOREIGN PATENT DOCUMENTS

| | | | | |
|---|---|---|---|---|
| WO | WO-2009001069 | A2 * | 12/2008 | ..... E21B 17/18 |
| WO | WO2010074581 | | 7/2010 | |
| WO | WO2010083166 | | 7/2010 | |
| WO | WO 2013186569 | | 12/2013 | |
| WO | WO-2013186569 | A2 * | 12/2013 | ..... E21B 33/129 |

OTHER PUBLICATIONS

Aidagulov et al., "Model of Hydraulic Fracture Initiation from the Notched Open hole," SPE-178027-MS, presented at the SPE Saudi Arabia Section Annual Technical Symposium and Exhibition, Apr. 21-23, 2015, 13 pages.

Aidagulov et al., "Notching as a New Promising Well Intervention Technique to Control Hydraulic Fracturing in Horizontal Open Holes," AAPG Datapages/Search and Discovery Article #90254, presented at the 12th Middle East Geosciences Conference and Exhibition GEO-2016, Mar. 7-10, 2016.

Al-Qahtani et al., "A Semi-Analytical Model for Extended-Reach Wells with Wellbore Flow Splitting; a Production Optimization Scheme," SPE-177931, presented at the Abu Dhabi International Petroleum Exhibition and Conference, Nov. 9-12, 2015, 21 pages.

Apageo.com [online] "Menard Pressuremeter Pressuremeter test according," 2016, retrieved on Oct. 7, 2019, retrieved from URL <https://www.apageo.com/en/3/products%2Cpressuremeter-tests%2Cmenard-pressuremeter%2C14%2C5.html>, 2 pages.

Azizi et al., "Design of Deep Foundations Using the Pressuremeter Method," Proceedings of the sixth International Offshore and Polar Engineering Conference, Los Angeles, May 1996, vol. 1, 9 pages.

Benafan et al., Shape Memory Alloy Rock Splitters (SMARS)—A Non-Explosive Method for Fracturing Planetary Rocklike Materials and Minerals, NASA STI Program, Jul. 2015, 42.

Hay, "Development of an Insitu Rock Shear Testing Device," Dissertation for the Degree of Doctor of Philosophy, University of Florida, Graduate School, 2007, 67 pages.

Hirata et al., "Estimation of Damaged Region Around a Tunnel By Compact VSP Probe Using Super Elastic Alloy," 9th IRSM Congress, International Society for Rock Mechanics, Jan. 1999, 4 pages.

Huang et al., "Pressuremeter Tests In Poorly Cemented Weak Rocks," Symposium; 37th, US rock mechanics: Rock mechanics for industry, 1999, Vail; CO, Proceedings of the US Rock Mechanics Symposium, vol. 1, pp. 247-252, 6 pages.

Kaneko et al., "Static Rock Splitter Using Shape Memory Alloy as Pressure Source," Journal of Mining and Materials Processing Institute of Japan, Jan. 1991, 4 pages.

Shi et al., "Research and Application of Drilling Technology of Extended-reach Horizontally-intersected Well Used to Extract Coalbed Methane," 2011 Xi'an International Conference on Fine Geological Exploration and Groundwater & Gas Hazards Control in Coal Mines, Procedia Earth and Panetary Science vol. 3, Dec. 2011, 9 pages.

Winkler et al., "Effects of borehole stress concentrations on dipole anisotropy measurements," Geophysics, vol. 63, No. 1, Jan. 1998, pp. 11-17, 7 pages.

Xi et al., "Uncertainty Analysis Method for Intersecting Process of U-Shaped Horizontal Wells," Arabian Journal for Science and Engineering, vol. 40, Issue 2, Feb. 2015, 12 pages.

* cited by examiner

PRESSURE TESTING SYSTEMS FOR SUBTERRANEAN ROCK FORMATIONS

TECHNICAL FIELD

This disclosure relates to pressure testing systems for subterranean rock formations, such as pressure testing systems designed to reestablish an initial stress state in a rock formation and subsequently determine mechanical properties of the rock formation.

BACKGROUND

Knowledge of various geomechanical properties of a rock formation can facilitate hydraulic fracturing and drilling operations at a wellbore within the rock formation. In order to accurately determine such properties, the rock formation should be tested at the wellbore in a manner that reflects an initial mechanical state of the rock formation before the rock formation was disturbed (for example, bored) by drilling. However, the process of drilling the wellbore changes the mechanical state of the rock formation to produce a post-drilling radial and tangential stress distribution that differs from an initial stress state of the rock formation and that varies around a circumference of the wellbore. Post-drilling radial and tangential stresses around the wellbore are generally less than the initial stress in the rock formation.

Therefore, pressuremeter test (PMT) devices that are deployed to wellbores to measure geomechanical properties of a surrounding rock formation are designed to first apply a preliminary radial stress load to a wall of a wellbore in an attempt to restore an initial stress state in a rock formation that has been disturbed due to drilling. A PMT device is designed to apply a preliminary radial stress load at a constant value around a circumference of a wellbore. This constant radial stress load can easily exceed the post-drilling tangential stress in the rock formation at certain angular positions around the wellbore at which the post-drilling tangential stress is relatively low, thereby causing the surrounding rock formation to fail (for example, crack or permanently deform prematurely. Premature failure of the rock formation can compromise the integrity of data acquired by any measurement tests subsequently performed at the wellbore by the PMT device.

SUMMARY

This disclosure relates to pressure testing systems designed to reestablish an initial stress state within a rock formation around a circumference of a wellbore that has changed due to drilling the of wellbore within the rock formation and to subsequently determine one or more in situ geomechanical properties of the rock formation. For example, the process of drilling the wellbore results in a post-drilling radial and tangential stress distribution that varies around a circumference of the wellbore according to anisotropic far-field stress contrasts around the wellbore. An example pressure testing system is designed to apply a radial pressure load to a wall of the wellbore that varies circumferentially (for example, according to an angle around the wellbore) to match a variable difference between the tangential stress distribution around the wellbore and the initial stress state to restore the initial stress state within the rock formation. Once the pressure testing system has reestablished the initial stress state around the wellbore, the pressure testing system can further probe the rock formation to obtain accurate geomechanical properties that reflect the initial state of the rock formation that was present prior to disturbance from drilling the wellbore.

In one aspect, a pressure testing system for analyzing a rock formation includes a tubular support member sized to pass into a wellbore of the rock formation and an adjustable loading device configured to exert a radial load against the wall of the wellbore. The adjustable loading device includes multiple expandable members distributed around a circumference of the tubular support member and configured to expand to respectively exert multiple radial pressures against the wall of the wellbore that together provide the radial load. The pressure testing system further includes a control module configured to selectively control expansion of each expandable member of the multiple expandable members to vary the radial load exerted by the adjustable loading device as a function of an angle around the circumference of the tubular support member.

Embodiments may provide one or more of the following features.

In some embodiments, the multiple expandable members include multiple inflatable members that are configured to inflate upon receiving hydraulic fluid and configured to deflate upon being emptied of hydraulic fluid.

In some embodiments, the pressure testing system further includes a surface tank containing the hydraulic fluid and in fluid communication with the multiple expandable members and one or more hydraulic pumps configured to move the hydraulic fluid between the multiple expandable members and the surface tank.

In some embodiments, the pressure testing further includes multiple pipes respectively connected to the multiple expandable members and fluidically communicating the multiple expandable members with the one or more hydraulic pumps and a deployment tube supporting the multiple pipes.

In some embodiments, the control module is further configured to control an amount of hydraulic fluid delivered to each expandable member of the multiple expandable members to vary the radial load exerted by the adjustable loading device as the function of the angle around the circumference of the tubular support member.

In some embodiments, the control module is further configured to determine a distribution of post-drilling stresses in the rock formation around the wellbore and an initial stress in the rock formation that was present prior to drilling of the wellbore in the rock formation.

In some embodiments, the control module is further configured to determine the distribution of post-drilling stresses based on far-field stress contrasts in the rock formation.

In some embodiments, the control module is further configured to selectively control expansion of each expandable member of the multiple expandable members such that a radial pressure exerted by the expandable member against the wall of the wellbore is equal to a difference between the initial stress in the rock formation and a post-drilling stress in the rock formation at an angular position of the expandable member to restore the initial stress in the rock formation.

In some embodiments, the control module is further configured to selectively control expansion of each expandable member of the multiple expandable members to exert a radial pressure against the wall of the wellbore to determine one or more mechanical properties of the rock formation.

In some embodiments, the multiple expandable members are distributed equidistantly around the circumference of the tubular support member.

In another aspect, a method of analyzing a rock formation includes providing a tubular support member that carries an adjustable loading device configured to exert a radial load against a wall of a wellbore. The adjustable loading device includes multiple expandable members distributed around a circumference of the tubular support member and configured to expand to respectively exert multiple radial pressures against the wall of the wellbore that together provide the radial load. The method further includes positioning the adjustable loading device in the wellbore and selectively expanding each expandable member of the multiple expandable members to vary the radial load exerted by the adjustable loading device as a function of an angle around the circumference of the tubular support member.

Embodiments may provide one or more of the following features.

In some embodiments, each expandable member of the multiple expandable members is inflatable, and the method further includes delivering hydraulic fluid to the multiple expandable members to inflate the multiple expandable members and removing hydraulic fluid from the multiple expandable members to deflate the multiple expandable members.

In some embodiments, the method further includes pumping hydraulic fluid between the multiple expandable members and a surface tank containing a supply of the hydraulic fluid.

In some embodiments, the method further includes delivering hydraulic fluid to the multiple expandable members through a multiple pipes respectively connected to the multiple expandable members and fluidically connected to one or more hydraulic pumps.

In some embodiments, the method further includes selectively delivering an amount of hydraulic fluid to each expandable member of the multiple expandable members to vary the radial load exerted by the adjustable loading device as the function of the angle around the circumference of the tubular support member.

In some embodiments, the method further includes determining a distribution of post-drilling stresses in the rock formation around the wellbore and an initial stress in the rock formation that was present prior to drilling of the wellbore in the rock formation.

In some embodiments, the method further includes determining the distribution of post-drilling stresses based on far-field stress contrasts in the rock formation.

In some embodiments, the method further includes selectively expanding each expandable member of the multiple expandable members such that a radial pressure exerted by the expandable member against the wall of the wellbore is equal to a difference between the initial stress in the rock formation and a post-drilling stress in the rock formation at an angular position of the expandable member.

In some embodiments, the method further includes restoring the initial stress in the rock formation.

In some embodiments, the method further includes selectively expanding each expandable member of the multiple expandable members to exert a radial pressure against the wall of the wellbore to determine one or more mechanical properties of the rock formation.

The details of one or more embodiments are set forth in the accompanying drawings and description. Other features, aspects, and advantages of the embodiments will become apparent from the description, drawings, and claims.

DETAILED DESCRIPTION

Figure 1:
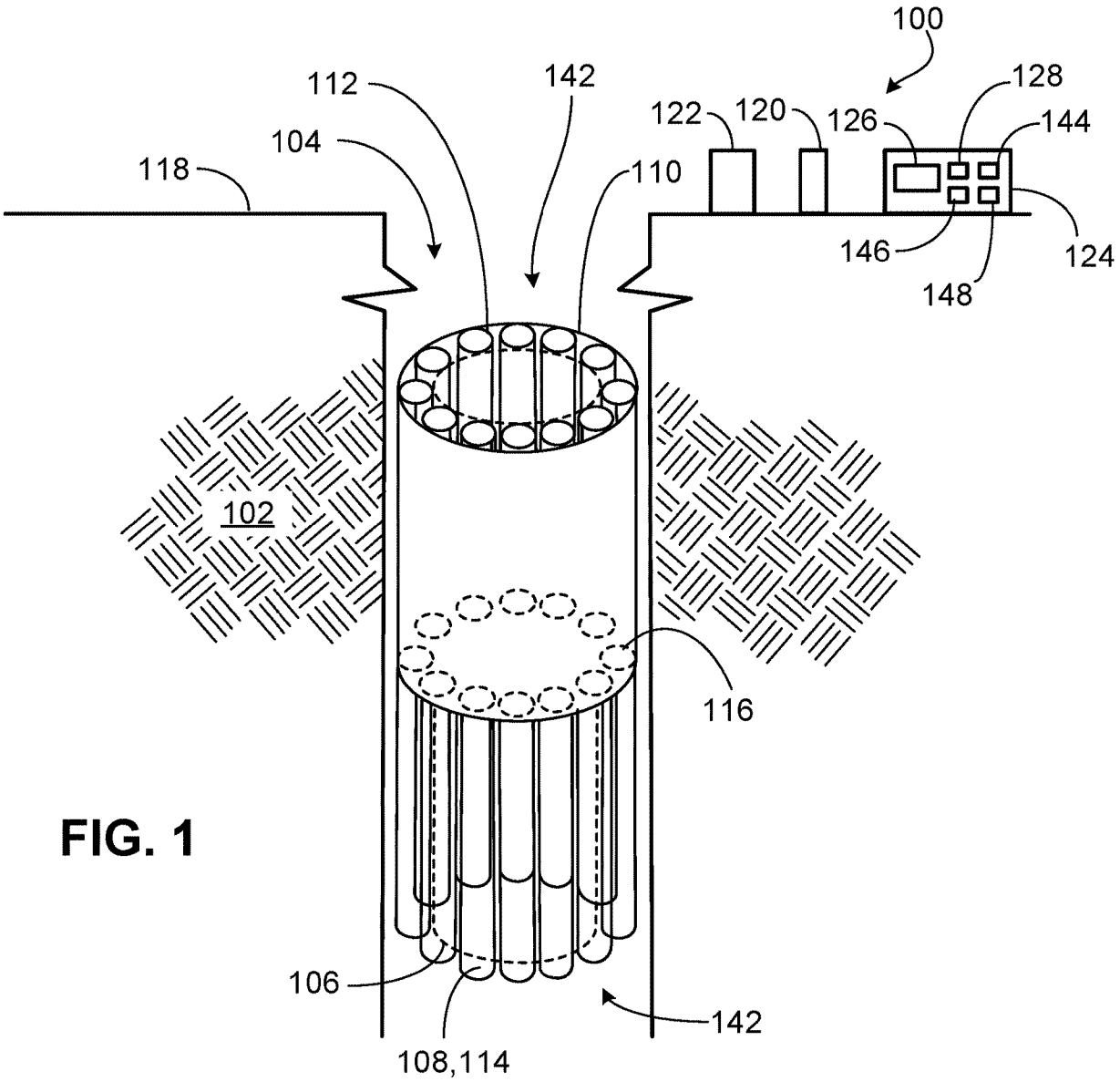
FIG. 1 is a perspective view of an example pressuremeter test system at a wellbore of a rock formation.

FIG. 1 illustrates a pressuremeter test system 100 that is designed to reestablish a an initial stress state (for example, a reference stress state) within a rock formation 102 around a wellbore 104 that has changed due to drilling of the wellbore 104 and to further determine in situ geomechanical properties (for example, elastic properties and failure properties) of the rock formation 102 once the initial stress state has been reestablished. For example, the process of drilling the wellbore 104 results in a post-drilling radial and tangential stress distribution that varies around a circumference of the wellbore 104 according to anisotropic far-field stress contrasts around the wellbore 104, which are regional stresses distributed in the rock formation 102 around the wellbore 104.

The pressuremeter test system 100 is a true-axial in situ system designed to apply a radial pressure load to a wall 140 of the wellbore 104 that varies circumferentially (for example, according to an angle around the wellbore). The radial pressure load is variably controlled to equal a variable difference between the tangential stress distribution around the wellbore 104 and the initial stress state to restore the initial stress state within the rock formation 102. In some examples, the initial stress state of the rock formation 102 may be predetermined from offset wells using mini fracing jobs and other methods.

Figure 2:
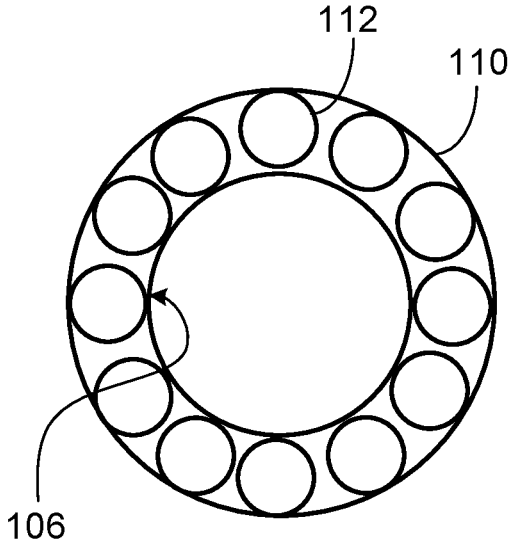
FIG. 2 is a top view of a downhole portion of the pressuremeter test system of FIG. 1, including a deployment tube, pipes, and a cylindrical probe.
Figure 3:
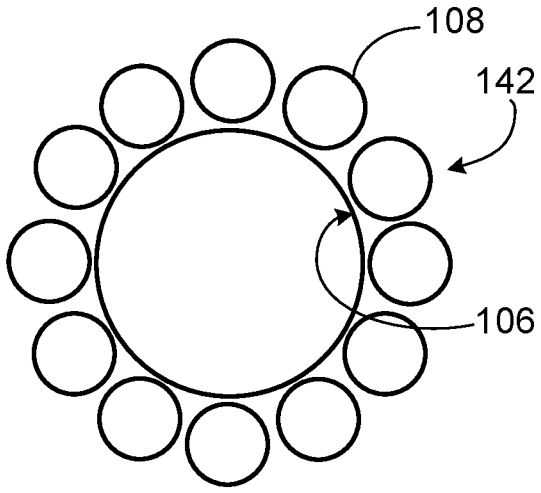
FIG. 3 is bottom view of the cylindrical probe and inflatable members of the pressuremeter test system of FIG. 1.

The pressuremeter test system 100 includes a cylindrical probe 106 that is deployed within the wellbore 104, multiple inflatable membranes 108 that are distributed about a circumference of the cylindrical probe 106, a deployment tube 110 that surrounds the cylindrical probe 106, and multiple pipes 112 that are protected by the deployment tube 110. Referring to FIGS. 1-3, the pipes 112 are coupled to an inner surface of the deployment tube 110, and the inflatable membranes 108 are carried on an outer surface of the cylindrical probe 106. The pipes 112 are located uphole of the inflatable members 108. The pipes 112 are respectively connected structurally and fluidically to the inflatable membranes 108 and can deliver selected amounts of hydraulic fluid to the inflatable membranes 108 to selectively expand the inflatable membranes 108 for applying varied radial pressure loads to the wall 140 of the wellbore 104 for matching a variable difference between the tangential stress distribution at the wellbore 104 and the initial stress state of the rock formation 102.

The inflatable membranes 108 collectively form an adjustable membrane 142 (for example, a configurable membrane) around the cylindrical probe 106 that can apply a radial pressure load to the wall 140 of the wellbore 104.

The inflatable membranes 108 are distributed approximately equidistantly around the cylindrical probe 106 and are closed at downhole ends 114 and open to the pipes 112 at uphole ends 116. The inflatable membranes 108 are fillable with the hydraulic fluid to achieve an expanded, pre-defined cylindrical shape and can collapse or contract upon removal of such hydraulic fluid. The inflatable membranes 108 are typically made of one or more compliant materials, such as sufficiently strong expandable elastomers, rubber materials, and expandable carbon steel. The cylindrical probe 106 provides support for the inflatable membranes 108 while the inflatable membranes 108 are pressurized with hydraulic fluid. The cylindrical probe 106 is made of one or more materials that can withstand harsh environmental parameters (for example, high temperatures, high pressures, and corrosive substances in a downhole environment), such as hard steel. Selections of lengths and diameters of the inflatable membranes 108 and the cylindrical probe 106 will generally depend on dimensions (for example, a length and a diameter) of the wellbore 104.

The pipes 112 and the deployment tube 110 extend in a downhole direction from a surface 118 of the rock formation 102. The pipes 112 are rigid structures that are typically made of sufficiently strong carbon steel or stainless steel. The deployment tube 110 defines an overall outer diameter of the pressuremeter test system 100 that is also equal to a diameter of a generally circular outer cross-sectional shape defined by the adjustable membrane 142. Selections of lengths and diameters of the pipes 112 and the deployment tube 110 will generally depend on dimensions (for example, a length and a diameter) of the wellbore 104.

Referring particularly to FIG. 1, the pressuremeter test system 100 also includes a surface tank 120 that contains a supply of the hydraulic fluid, one or more hydraulic pumps 122 that move the hydraulic fluid between the surface tank 120 and the inflatable membranes 108 via the pipes 112, and a control module 124. Example hydraulic fluids that may be stored in the surface tank 120 include incompressible liquids, such as viscous water.

The control module 124 includes software 148 and hardware (for example, input devices 144, gauges 146, and a display screen 126) by which an operator can input settings to control pressure loading at the inflatable membranes 108 and monitor associated mechanical measurements obtained at the wellbore 104. The control module 124 also includes one or more processors 128 by which the control module 124 can execute the software 148 to generate user interfaces at the display screen 126 and to access field data, other input data, and computational models (for example, correlation models and analytical models). Using the data and the analytical models, the control module 124 can determine (for example, calculate or receive as an input) the initial stress state of the rock formation 102, the far-field stress contrasts around the wellbore 104, the post-drilling radial and tangential stress distribution around the wellbore 104 that depends on the far-field stress contrasts, and radial pressure loads to be applied respectively by the inflatable membranes 108 and corresponding volumes of hydraulic fluid that should be delivered to or removed from the inflatable membranes 108 to produce the radial pressure loads.

Figure 4:
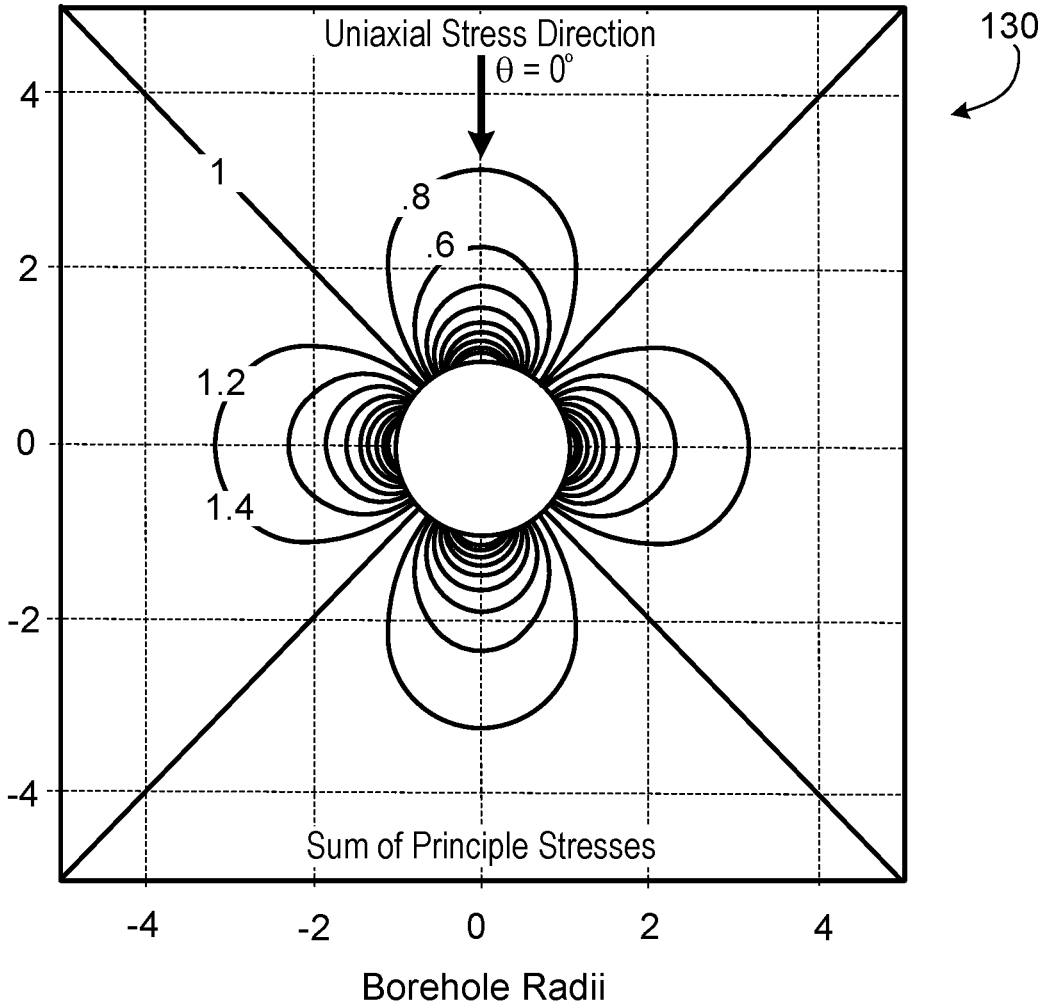
FIG. 4 illustrates an example graph of a post-drilling, in situ principle stress distribution around the wellbore in the rock formation of in FIG. 1.
Figure 5:
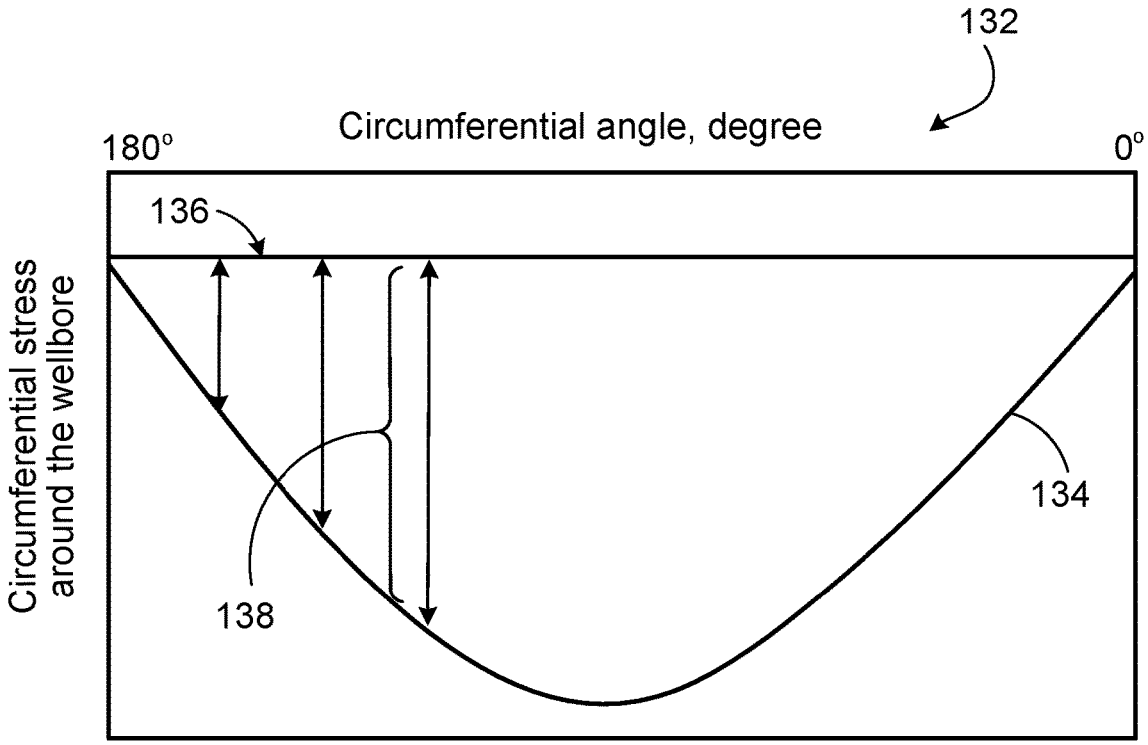
FIG. 5 illustrates an example graph of a post-drilling in situ tangential stress around the wellbore and an initial, in situ stress in the rock formation of FIG. 1 at the location of the wellbore before drilling the wellbore.

FIG. 4 illustrates an example graph 130 of an in situ principle stress distribution around the wellbore 104 after drilling the wellbore 104 in the rock formation 102. The principle stresses are calculated based on the magnitudes of radial, tangential, and shear stresses. As shown in the graph 130, the principle stress varies as a function of an angle θ around the circumference of the wellbore 104. As discussed above, the radial and tangential stress distribution around the wellbore 104 after drilling is different from the initial stress state in the rock formation 102 at the location of the wellbore 104. For example, FIG. 5 illustrates an example graph 132 of post-drilling, in situ tangential stress 134 around the wellbore 104 and an initial, in situ stress 136 in the rock formation 102 at the location of the wellbore 104 before drilling the wellbore 104. As shown in FIG. 5, the initial stress 136 is a constant value that does not vary as a function of angle, whereas the tangential stress 134 varies (for example, variably decreases) from the initial stress 136 as a function of the angle around the circumference of the wellbore 104.

The control module 124 is programmed to use one or more of field data, other known data, and computational models to determine the tangential stress 134 around the circumference of the wellbore 104 based on the far field stress contrasts. The control module 124 is accordingly programmed to control volumes of hydraulic fluid that are delivered respectively to the inflatable membranes 108 to apply radial stresses to the wall 140 of the wellbore 104. The radial stress applied by each inflatable membrane 108 to the wall 140 of the wellbore 104 is approximately equal to a difference 138 between the initial stress 136 and the post-drilling tangential stress 134 at a given angle around the circumference of the wellbore 104 to restore the initial stress state in the rock formation 102 at the location of the wellbore 104.

Once the pressuremeter test system 100 has reestablished the initial stress state by preliminarily applying the initial radial pressure loading to the wellbore 104, the pressuremeter test system 100 can be controlled to test the rock formation 102 to obtain geomechanical properties that advantageously reflect the initial stress state (for example, a true and realistic stress state) of the rock formation 102 that was present prior to disturbance from drilling the wellbore 104. For example, the cavity expansion theory can be implemented to load the wellbore 104 by expanding the adjustable membrane 108. By establishing a strain-stress relationship using a suitable constitutive material law, the geomechanical characteristics can be solved analytically or numerically. The test is performed by either applying incremental pressure or volume. The incremental loading is controlled based on the type of rock and soil present at the wellbore 104. In some examples, 25, 50, 100, and 250 kilopascals (kPa) are pressures that may be selected for testing soil. Example geomechanical properties of the rock formation 102 that may be obtained by the pressuremeter test system 100 include rock strength, deformational characteristics, shear modulus, bulk modulus, and in-situ stresses. In some examples, measurements obtained and analysis performed by the pressuremeter test system 100 may inform new empirical relationships that can be used to characterize the geomechanical properties of various rock formations.

In contrast, conventional pressuremeter test systems are not able to vary a pressure applied to a wall of the wellbore as a function of an angle around the wellbore. For example, conventional pressuremeter test systems are designed to apply a constant pressure to a wall of a wellbore around a circumference of the wellbore, leading to an inappropriate initial loading state that can quickly exceed a tensile strength of a given circumferential section of the wellbore. Such a loading state can cause premature failure of the rock formation 102 and therefore lead to compromised geomechanical measurements that do not represent the true in situ tensile strength of the rock formation. The pressuremeter test system 100, however, maintains the integrity of data gathered subsequent to application of the preliminary radial pressure load at the wellbore 104.

Figure 6:
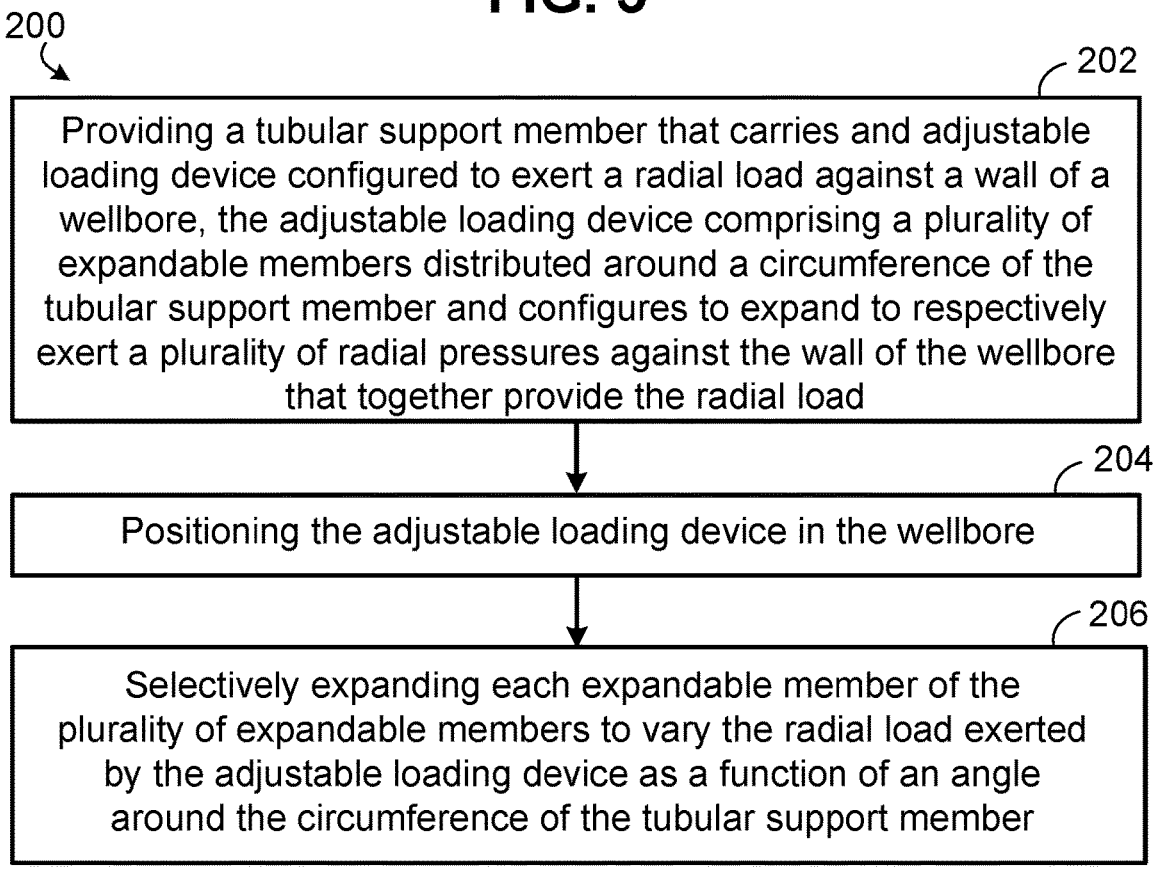
FIG. 6 is a flow chart illustrating an example method of analyzing a rock formation using the pressuremeter test system of FIG. 1.

FIG. 6 is a flow chart illustrating an example method 200 of analyzing a rock formation (for example, the rock formation 102). In some embodiments, the method 200 includes providing a tubular support member (for example, the cylindrical probe 106) that carries an adjustable loading device (for example, the adjustable membrane 142) configured to exert a radial load against a wall (for example, the wall 140) of a wellbore (for example, a wellbore 104), the adjustable loading device including multiple expandable members (for example, the inflatable membranes 108) distributed around a circumference of the tubular support member and configured to expand to respectively exert multiple radial pressures against the wall of the wellbore that together provide the radial load (202). In some embodiments, the method 200 further includes positioning the adjustable loading device in the wellbore (204). In some embodiments, the method 200 further includes selectively expanding each expandable member of the multiple expandable members to vary the radial load exerted by the adjustable loading device as a function of an angle around the circumference of the tubular support member (206).

While the pressuremeter test system 100 has been described and illustrated with respect to certain dimensions, sizes, shapes, arrangements, materials, and methods 200, in some embodiments, a pressuremeter test system that is otherwise substantially similar in construction and function to the pressuremeter test system 100 may include one or more different dimensions, sizes, shapes, arrangements, and materials or may be utilized according to different methods.

Accordingly, other embodiments are also within the scope of the following claims.

What is claimed is:

1. A pressure testing system for analyzing a rock formation, the pressure testing system comprising:

a tubular support member sized to pass into a wellbore of the rock formation;

an adjustable loading device configured to exert a radial load against the wall of the wellbore, the adjustable loading device comprising a plurality of expandable members distributed around a circumference of the tubular support member and configured to expand to respectively exert a plurality of radial pressures against the wall of the wellbore that together provide the radial load; and a control module configured to:

selectively control expansion of each expandable member of the plurality of expandable members to vary the radial load exerted by the adjustable loading device as a function of an angle around the circumference of the tubular support member, and determine a distribution of post-drilling stresses in the rock formation around the wellbore and an initial stress in the rock formation that was present prior to drilling of the wellbore in the rock formation.

2. The pressure testing system of claim 1, wherein the plurality of expandable members comprises a plurality of inflatable members that are configured to inflate upon receiving hydraulic fluid and configured to deflate upon being emptied of hydraulic fluid.

3. The pressure testing system of claim 2, further comprising:

a surface tank containing the hydraulic fluid and in fluid communication with the plurality of expandable members; and one or more hydraulic pumps configured to move the hydraulic fluid between the plurality of expandable members and the surface tank.

4. The pressure testing system of claim 3, further comprising:

a plurality of pipes respectively connected to the plurality of expandable members and fluidically communicating the plurality of expandable members with the one or more hydraulic pumps; and a deployment tube supporting the plurality of pipes.

5. The pressure testing system of claim 2, wherein the control module is further configured to control an amount of hydraulic fluid delivered to each expandable member of the plurality of expandable members to vary the radial load exerted by the adjustable loading device as the function of the angle around the circumference of the tubular support member.

6. The pressure testing system of claim 1, wherein the control module is further configured to determine the distribution of post-drilling stresses based on far-field stress contrasts in the rock formation.

7. The pressure testing system of claim 1, wherein the control module is further configured to selectively control expansion of each expandable member of the plurality of expandable members such that a radial pressure exerted by the expandable member against the wall of the wellbore is equal to a difference between the initial stress in the rock formation and a post-drilling stress in the rock formation at an angular position of the expandable member to restore the initial stress in the rock formation.

8. The pressure testing system of claim 7, wherein the control module is further configured to selectively control expansion of each expandable member of the plurality of expandable members to exert a radial pressure against the wall of the wellbore to determine one or more mechanical properties of the rock formation.

9. The pressure testing system of claim 1, wherein the plurality of expandable members is distributed equidistantly around the circumference of the tubular support member.

10. A method of analyzing a rock formation, the method comprising:

providing a tubular support member that carries an adjustable loading device configured to exert a radial load against a wall of a wellbore, the adjustable loading device comprising a plurality of expandable members distributed around a circumference of the tubular support member and configured to expand to respectively exert a plurality of radial pressures against the wall of the wellbore that together provide the radial load;

positioning the adjustable loading device in the wellbore;

selectively expanding each expandable member of the plurality of expandable members to vary the radial load exerted by the adjustable loading device as a function of an angle around the circumference of the tubular support member; and determining a distribution of post-drilling stresses in the rock formation around the wellbore and an initial stress in the rock formation that was present prior to drilling of the wellbore in the rock formation.

11. The method of claim 10, wherein each expandable member of the plurality of expandable members is inflatable, the method further comprising delivering hydraulic fluid to the plurality of expandable members to inflate the plurality of expandable members and removing hydraulic fluid from the plurality of expandable members to deflate the plurality of expandable members.

12. The method of claim 11, further comprising pumping hydraulic fluid between the plurality of expandable members and a surface tank containing a supply of the hydraulic fluid.

13. The method of claim 12, further comprising delivering hydraulic fluid to the plurality of expandable members through a plurality of pipes respectively connected to the plurality of expandable members and fluidically connected to one or more hydraulic pumps.

14. The method of claim 11, further comprising selectively delivering an amount of hydraulic fluid to each expandable member of the plurality of expandable members to vary the radial load exerted by the adjustable loading device as the function of the angle around the circumference of the tubular support member.

15. The method of claim 10, further comprising determining the distribution of post-drilling stresses based on far-field stress contrasts in the rock formation.

16. The method of claim 10, further comprising selectively expanding each expandable member of the plurality of expandable members such that a radial pressure exerted by the expandable member against the wall of the wellbore is equal to a difference between the initial stress in the rock formation and a post-drilling stress in the rock formation at an angular position of the expandable member.

17. The method of claim 16, further comprising restoring the initial stress in the rock formation.

18. The method of claim 16, further comprising selectively expanding each expandable member of the plurality of expandable members to exert a radial pressure against the wall of the wellbore to determine one or more mechanical properties of the rock formation.

* * * * *